US009555991B2

(12) United States Patent
Staehli

(10) Patent No.: US 9,555,991 B2
(45) Date of Patent: Jan. 31, 2017

(54) ROTATING DEVICE FOR FLAT PRODUCTS OR FOR A STACK THEREOF

(71) Applicant: KERN AG, Konolfingen (CH)

(72) Inventor: Sven Staehli, Bern (CH)

(73) Assignee: KERN AG, Konolfingen (CH)

( * ) Notice: Subject to any disclaimer, the term of this patent is extended or adjusted under 35 U.S.C. 154(b) by 0 days.

(21) Appl. No.: 14/409,518

(22) PCT Filed: Jun. 25, 2013

(86) PCT No.: PCT/EP2013/063232
§ 371 (c)(1),
(2) Date: Dec. 23, 2014

(87) PCT Pub. No.: WO2014/001307
PCT Pub. Date: Jan. 3, 2014

(65) Prior Publication Data

US 2015/0246786 A1 Sep. 3, 2015

(30) Foreign Application Priority Data

Jun. 29, 2012 (CH) ..... 919/12

(51) Int. Cl.

| | |
|---|---|
| ***B65H 9/00*** | (2006.01) |
| ***B65H 5/06*** | (2006.01) |
| ***B65H 15/00*** | (2006.01) |
| ***B65H 15/02*** | (2006.01) |

(52) U.S. Cl.
CPC ..... *B65H 9/002* (2013.01); *B65H 5/062* (2013.01); *B65H 9/00* (2013.01); *B65H 15/00* (2013.01); *B65H 15/02* (2013.01); *B65H 2301/33214* (2013.01); *B65H 2301/33216* (2013.01); *B65H 2404/14* (2013.01); *B65H 2404/144* (2013.01);
(Continued)

(58) Field of Classification Search
CPC ..... B65H 9/002
See application file for complete search history.

(56) References Cited

U.S. PATENT DOCUMENTS 4,155,440 A 5/1979 Bogdanski et al.
4,971,304 A * 11/1990 Lofthus ..... B65H 7/06 198/395

(Continued)

FOREIGN PATENT DOCUMENTS

| | | |
|---|---|---|
| DE | 102 19 569 A1 | 11/2003 |
| DE | 10 2007 054 822 A1 | 5/2009 |
| WO | WO 2010/029408 A1 | 3/2010 |

OTHER PUBLICATIONS

Jan. 12, 2015 International Preliminary Report on Patentability issued in European Application No. PCT/EP2013/063232.

(Continued)

*Primary Examiner* — Thomas Randazzo
(74) *Attorney, Agent, or Firm* — Oliff PLC

(57) ABSTRACT

In a device for rotating a stack of two-dimensional sheet-type or film-type products, or a stack thereof, at least two drive-roller pairs (11, 12; 13, 14) which are disposed beside one another so as to be spaced apart for conveying the products (1) are provided, the drive speed of said drive-roller pairs being modifiable in such a manner that the two roller pairs, oriented toward the same conveying direction, are operable at different speeds.

15 Claims, 4 Drawing Sheets

(52) U.S. Cl.
CPC ... *B65H 2701/1916* (2013.01); *B65H 2801/66* (2013.01)

(56) References Cited

U.S. PATENT DOCUMENTS

| | | | | | |
|---|---|---|---|---|---|
| 5,078,384 | A * | 1/1992 | Moore | B65H 7/08 | 271/228 |
| 5,090,683 | A * | 2/1992 | Kamath | B65H 5/34 | 271/184 |
| 5,114,137 | A | 5/1992 | Olson | | |
| 6,533,268 | B2 * | 3/2003 | Williams | B65H 9/002 | 271/228 |
| 7,243,917 | B2 * | 7/2007 | Knierim | B65H 9/002 | 271/227 |
| 7,258,340 | B2 * | 8/2007 | Clark | B65H 5/06 | 271/186 |
| 8,056,897 | B2 * | 11/2011 | deJong | B65H 9/002 | 271/227 |
| 8,085,412 | B2 * | 12/2011 | Nishitani | B65H 9/002 | 271/251 |
| 8,210,526 | B2 * | 7/2012 | Ponti | B65H 15/00 | 271/184 |
| 8,376,357 | B2 * | 2/2013 | Tharayil | B65H 7/06 | 271/228 |
| 8,584,832 | B2 * | 11/2013 | Depoi | B65H 5/062 | 198/379 |
| 2011/0132722 | A1 | 6/2011 | Depoi et al. | | |

OTHER PUBLICATIONS

International Search Report and Written Opinion dated Oct. 15, 2013; International Application No. PCT/EP2013/063232; International Filing Date: Jun. 25, 2013.

* cited by examiner

ROTATING DEVICE FOR FLAT PRODUCTS OR FOR A STACK THEREOF

RELATED APPLICATIONS

This application is a U.S. national phase application under 35 U.S.C. §371 of International Application Number PCT/EP2013/063232 filed Jun. 25, 2013 with claiming priority of Switzerland Application Number 919/12 dated Jun. 29, 2012.

TECHNICAL FIELD

The present invention relates to a device for rotating stacks of sheet-type or film-type products, or a stack thereof, such as in particular documents, letters, and the like, and to a method for rotating at least one sheet-type or film-type product, in particular rotating groups, i.e. loose stacks, of a plurality of documents or sheets. The present invention relates in particular to a device for rotating documents and letters and the like, for example in the infeed into a packaging installation, such as for envelope-filling into envelopes.

BACKGROUND AND SUMMARY

In envelope-filling technology nowadays, the documents are mostly printed and processed so as to be 2-up, that is to say having two documents beside one another. The documents mostly have the standardized format of DIN-A4, letter or legal, and are printed in a portrait style (on end). On the other hand, in envelope-filling technology nowadays envelope-filling is preferably carried out into envelopes which have the opening and thus the envelope flap on the long side. In order to process applications in which the documents are folded in order to be packed into envelopes of the C5, C6/5, or similar formats, on account of folding the short edge of the portrait-fed initial document automatically becomes the long edge of the folded format. The document, which has been infed in the portrait style having the short edge leading, may thus be packed in the folded format having the long edge leading into the envelope.

If, for example, documents infed in the portrait format are to be packed unfolded into a C4 envelope on one and the same machine, the documents have to be rotated by 90° in order for them to be able to be conveyed and envelope-filled having the long edge leading (landscape style) and without having to deflect said documents by 90° (i.e. to convey them onward in a lateral manner), which then would prevent processing of folded applications. The direction of rotation, to the right or to the left, is mostly determined by the position of the window in the envelope.

It is proposed in patent CA1077534 (family: DE2829221A1/U.S. Pat. No. 4,155,440A) titled "Document Turning Station" to rotate a document by 90° by way of a plurality of rollers which are disposed parallel to one another and rotate at different speeds. Rotation here takes place about a corner of the document. In this variant of rotation the center axis is thus permanently displaced in the conveying direction.

DE 10219569A1 titled "Rotating installation of an ID card" a rotating installation which by means of rotating balls and a stop rotates ID cards about said stop. This method has the disadvantage that it can be employed only for rigid objects; a single document would be bent and damaged, a stack of documents could not be processed as it would slide apart. Moreover, the method is reliant on conveying the object to be rotated along a curved edge, which is not possible with a corner of a sheet of paper.

In U.S. Pat. No. 5,114,137 titled "Right Angle Turn Table and Method" a rotating installation for rotating documents by means of two conveyor belts which operate at different speeds is described. The long space requirement, the inaccurate rotation requiring subsequent lateral alignment, which in the case of thin sheets may often lead to a rising of the edge and thus to disruptions are disadvantageous. Furthermore, a stack of documents cannot be processed using this solution, since the document on the lower side merely bears on two belts and on the upper side is merely guided by light rollers. Moreover, a stack of documents would slide apart when impacting the stop roller which initiates the rotation. Furthermore, there is the risk of damage to the edge of the sheet by the stop which initiates the rotation and about which the document is rotated.

In DE 102007054822A1 a "Device for rotating flat objects, in particular blanks for folding boxes" is proposed. On account of the free rotation said device is not suitable for rotating light sheets of paper which, on account of their very light dead weight, would shift out of place in an uncontrolled manner. Rotating a stack of sheets is not at all possible, since said stack would also internally shift out of place. The unit requires a large space. The alignment of the entire unit which is additionally required in order to achieve a good rotation result, for optimization moreover requires a large number of identical objects to be rotated, while in the case of the requirements of the present remit various thicknesses and numbers of sheets may occur from one object to another.

The object of the present invention lies in proposing a further solution for rotating sheet-type products, such as, in particular, documents individually or in stacks, letters, and the like, which enables an increased throughput rate in the case of the rotating operation, requires little space, enables a variable thickness to be processed and also processing of a plurality of loosely stacked documents, and all this without permanently displacing the conveying axis.

According to the invention a device and a method as disclosed herein are proposed.

The present invention proposes a solution by way of which this rotating operation can be performed at a significantly higher throughput rate and less strain on both the documents and the machine elements.

The objects to be rotated are individual documents or document groups of a plurality of documents which are stacked on top of one another or, in more general terms, two-dimensional objects. Elsewhere, these may also be envelopes, non-filled, filled, having an open or closed flap. The documents or document groups are infed into the chain of the entry modules in the portrait style (longitudinally). The rotating device has the task of rotating the documents/document groups by 90°, selectively in a clockwise or counter-clockwise manner, so that said documents/document groups can subsequently be infed in the landscape style (transversely) to the enveloping module. Of course, the rotation from landscape to portrait or of equilateral documents or those of non-rectangular shape is also possible. Documents which are already delivered in the correct orientation, that is to say folded documents for example, have to be able to be conveyed by the rotating device without rotating.

The center of the document should lie both ahead of the rotation and after the rotation on the same axis. During the rotating operation, the center of the document can travel along a curve of any desired shape, however.

Stopping the documents with subsequent on-the-spot rotation during start-stop operation requires a relatively large amount of time; cycle times which are required in the future can therefore no longer be achieved. A principle is therefore required which rotates the documents in a controlled manner by 90° in the desired direction within a short time, but without permanently displacing the document laterally in the process and optionally also allowing documents which are not to be rotated to be conveyed onward.

The rotation of the documents is implemented by two roller pairs which rotate at different speeds and in this manner set the document (or the document group) which is clamped between the rollers into a rotating movement. The two drive-roller pairs may in each case dispose of a separate drive.

It is proposed that the roller pairs, oriented toward the same conveying direction, rotate at different speeds and conveying of the documents is not interrupted, i.e. that no start-stop operation takes place, as is known in part from the prior art.

Further variants of embodiments of the device and also of the inventive method are characterized in the dependent claims.

The invention is now explained in more detail in an exemplary manner and with reference to the appended figures.

DETAILED DESCRIPTION OF EMBODIMENTS

Figure 1:
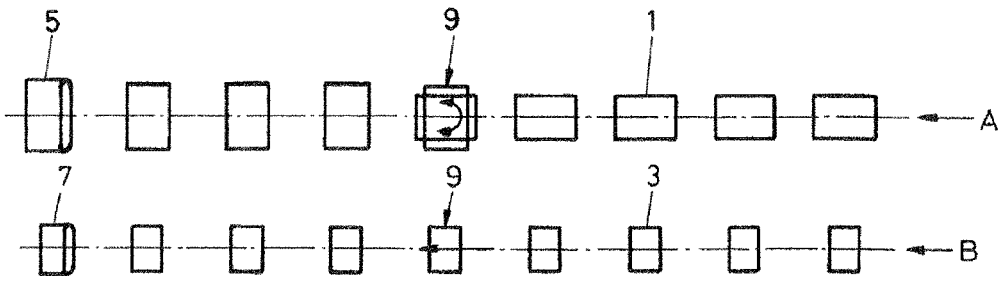
FIG. 1 shows in a schematic manner the orientation of the documents prior to and after the rotating device.

FIG. 1 shows in a schematic manner a conveying installation, wherein the document 1 is conveyed so as to be initially oriented in a rectangular manner in the longitudinal direction in the conveying direction A. In order to ultimately be able to be infed in a correctly oriented manner to an enveloping unit having an envelope 5, the document 1 has to be rotated by 90° in a rotating device 9. It is advantageous that documents 3 which have been correctly conveyed from the outset can be infed to an envelope 7 without rotation on the same conveying installation. This is illustrated in a schematic manner along the conveying direction B in FIG. 1, wherein no rotation takes place in the region 9.

In the special case it is also possible to process objects to be rotated and objects not to be rotated in an arbitrarily alternating manner in the device, that is to say that an object to be rotated may also be followed, for example, by an object not to be rotated which is conveyed through the device without being rotated, while the previous object was rotated.

Figure 2A:
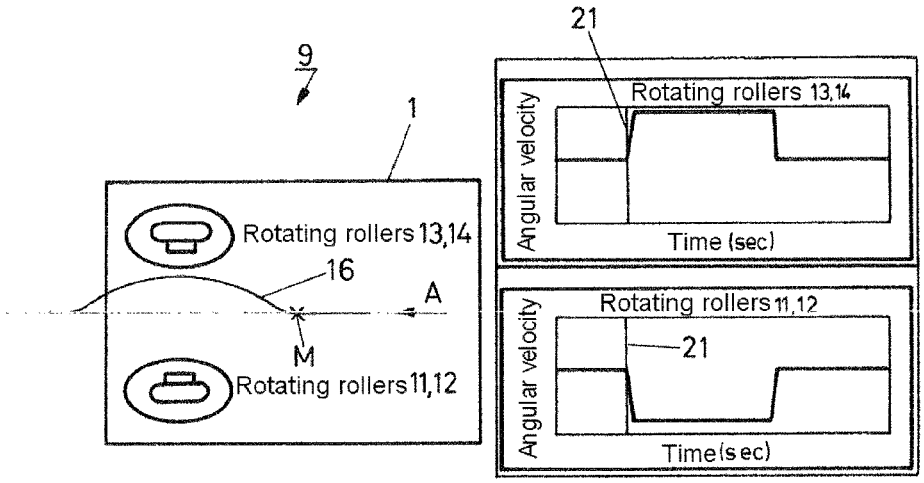
FIGS. 2*a*-2*c* show in a schematic manner the rotating operation of a document in the device according to the invention, prior to, during, and after the rotating operation.
Figure 2B:
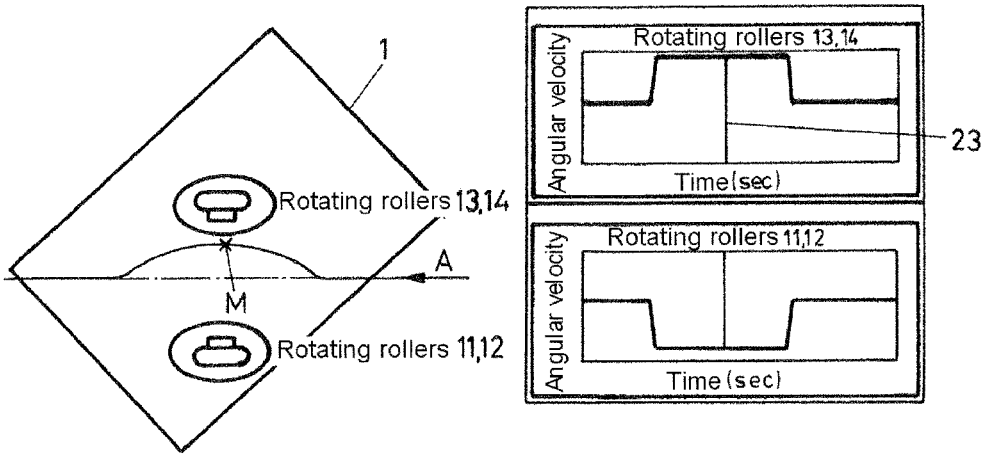
Figure 2C:
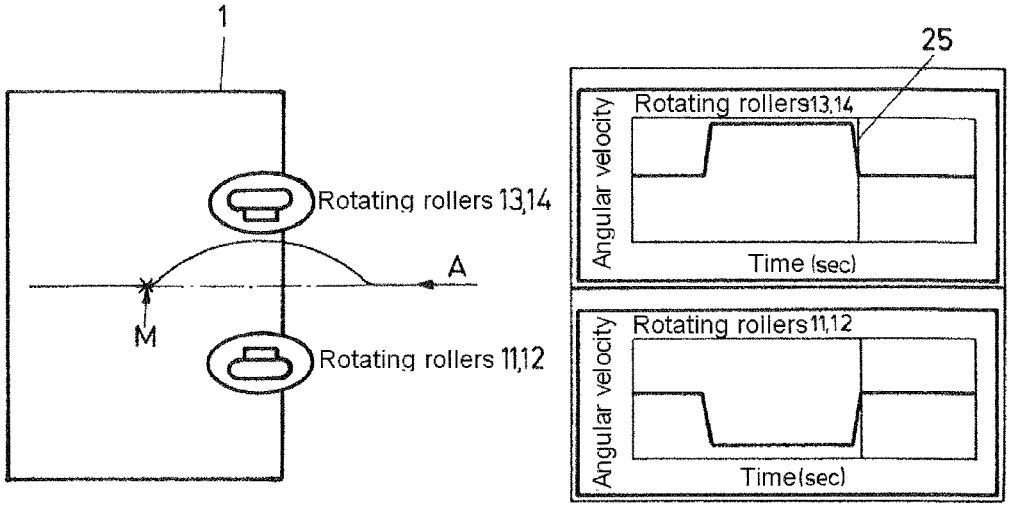

In FIGS. 2*a*-2*c* the rotating operation for a document 1 in the rotating device 9 is schematically illustrated, in FIG. 2*a* prior to the rotating operation, in FIG. 2*b* during the rotating operation, and in FIG. 2*c* after completion of the rotating operation.

In order to acquire the documents 1, both roller pairs 11, 12 and 13, 14 of the rotating device 9 rotate at the same speed. It is decisive that the speeds of the two rotating-roller pairs are increased or decreased, respectively, at the right moment, in order for the rotating movement to be initiated. Depending on the desired direction of rotation, the speed of the left-hand rotating-roller pair 11, 12 is decreased, and the speed of the right-hand rotating-roller pair 13, 14 is increased (in the conveying direction; for rotation in the counter-clockwise direction) or vice versa (clockwise direction). It is likewise decisive that the two speeds are equalized again at the right moment, such that the document is conveyed onward in a linear manner, having been rotated by exactly 90°. This speed adjustment at the right moment causes documents which have been symmetrically infed to still lie symmetrically under the rotating rollers even after rotation. The advantage in comparison to rotation in the start-stop operation, where documents are stopped and rotated on the spot, is that the rotating movement occurs on the run during conveying. On account thereof, the time-consuming start-stop operation can be avoided. It is at least equally important that on account of the rotating movement which occurs on the run the document stack does not shift out of place or scale (shifting out of place of individual sheets in the stack), which is in contrast to a start-stop motion where this can hardly be avoided. On account of the timely and accurate modification of the speed of the two rotating-roller drives it is moreover ensured that the document lies symmetrically under the rotating rollers also after the rotating movement and is conveyed symmetrically out of the rotating device. Subsequently, the rotated document is acquired by two further conveying rollers which rotate at the same speed and conveyed onward, as is described in more detail in the following with reference to FIG. 5.

In the extreme case, a rotating-roller pair may also be decelerated to zero, and the speed of the other rotating-roller pair is increased by the corresponding amount. In this case, the document is directly rotated about the stationary roller pair.

In FIGS. 2*a*-2*c* the rotating operation is illustrated by way of 3 diagrams (illustration on the left), including the schematic progress of the speed profiles (illustration on the right). The central curve 16 represents the path of the center M of the document 1. Since rotation starts before the center of the document has reached the rollers, the document is conveyed out of the center of the conveying axis A. Since rotation continues after the center of the document has passed the rotating rollers, the center is subsequently displaced again, such that upon termination of the rotating operation the center of the document again lies on the center of the conveying axis A, as required. For this reason, the above invention is different from on-the-spot rotation. In the case of an operation according to on-the-spot rotation with start-and-stop, when the documents lie centrally on the rotation unit, rotation takes place about the almost immovable center of the document.

In the right-hand illustration of the schematic progress of the speed profiles of the two rotating-roller pairs 11, 12 and 13, 14, the moment at which the center of the document D1 is situated at the position which is drawn in the left-hand illustration is illustrated in a schematic manner as line 21.

In FIG. 2*a* the document is situated at the commencement of the rotation, in FIG. 2*b* mid-way through the rotation (indicated by 23), and in FIG. 2*c* after the completed rotation (indicated by 25).

The exact moment of the modification of the speed may be defined by way of monitoring the position and speed by means of suitable sensors, preferably light barriers and rev transmitters, and corresponding calculations by the controller, depending on the length of the document.

Figure 3:
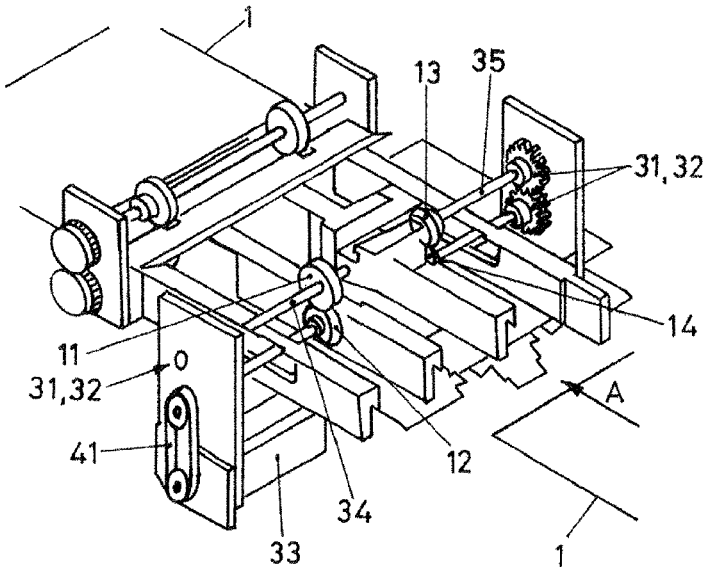
FIG. 3 shows in a perspective view the construction of a rotating device.
Figure 4:
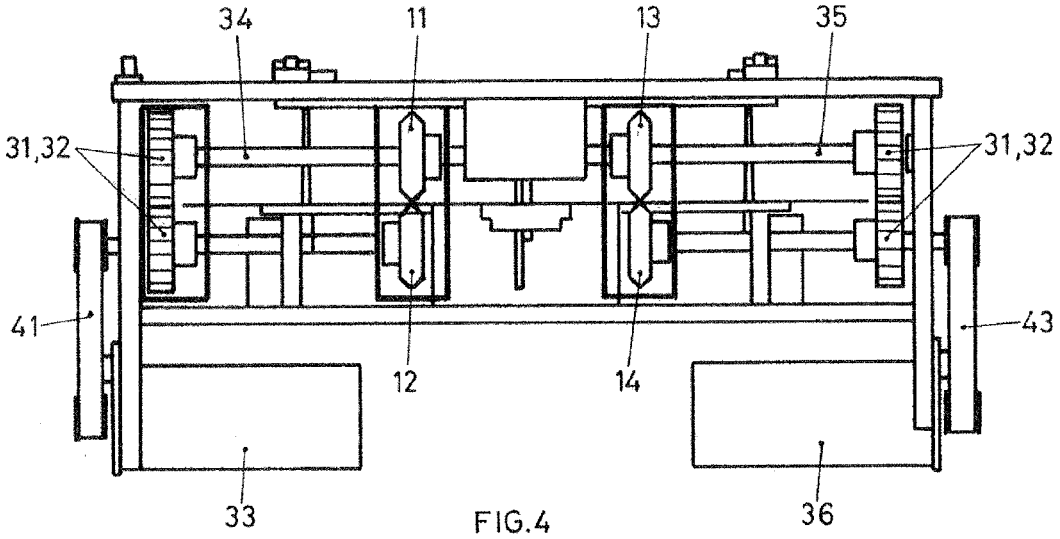
FIG. 4 shows in a view in the conveying direction the rotating device as illustrated in FIG. 3.

In FIGS. 3 and 4 the construction of a rotating device is shown in a schematic manner in a perspective view and in a front view. According to one variant of embodiment, the two roller pairs 11, 12 and 13, 14 are individually driven by servomotors 33, 36, for example. Driving may take place by means of belts 41, 43, for example, wherein the drive is transmitted to corresponding shafts on which the roller pairs are mounted.

In order to ensure the reliable processing of entire groups (stacks) of documents, preferably both the upper and the lower rotating rollers are driven, since a counter-pressure roller which merely runs conjointly in most cases leads to scaling/misalignment of the stack.

The transmission from the lower to the upper roller may take place via gear wheels 31, 32. Since both individual documents and groups of up to a thickness of a few millimeters have to be processed, the upper shafts 34, 35 are sprung and may deflect upward.

The two upper shafts 34 are mounted in a common bearing block, for example, so that they can collectively be pushed upward and no oblique positioning may arise which would potentially have a negative effect on the accuracy of the rotation movement.

Instead of the gear wheels used for the transmission of the sprung rollers, solutions by means of toothed belts or other known machine elements are also conceivable, as is the employment of two separate drives for the upper and lower drive roller.

The mounting in a common bearing block is one possible embodiment. Separate mounting is in any case also possible in order, for example, for objects which are not of the same thickness on the left and the right to be able to be processed.

Further embodiments, such as elastic rollers instead of springs, or entirely dispensing with a suspension, in the case of only processing thin objects are conceivable.

Besides the mentioned shape of a typical drive roller, it is of course also possible for spherical drive rollers or similar to be used.

Figure 5A:
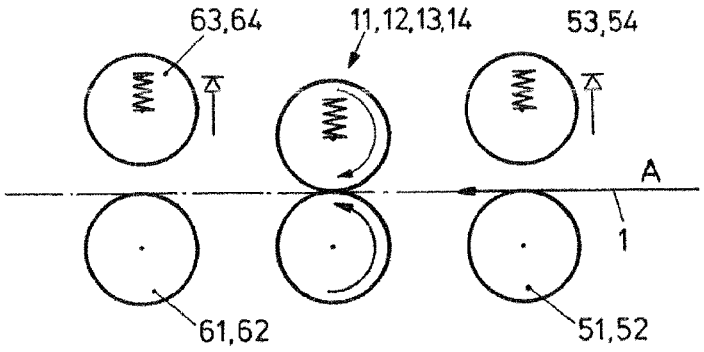
FIGS. 5*a*-*c* show in a schematic manner upstream and downstream conveying rollers during the rotating operation and when conveying documents.
Figure 5B:
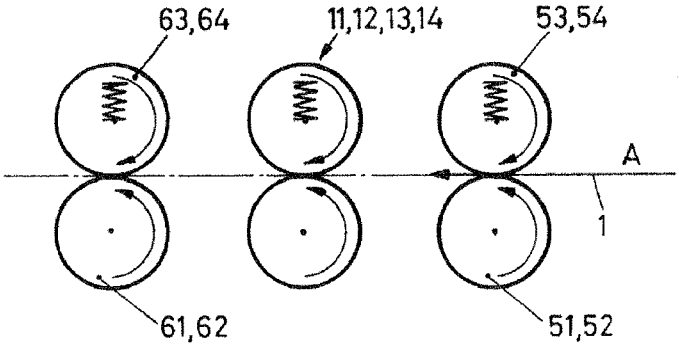
Figure 5C:
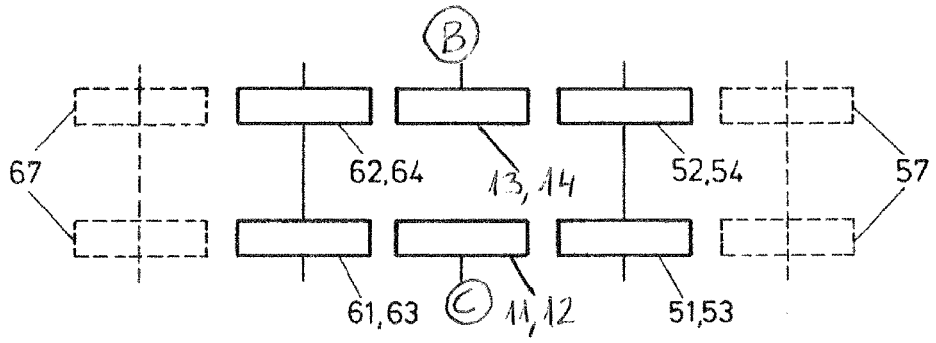

In order for also comparatively small document formats to be able to be conveyed through the rotating device, additional conveying rollers may be placed ahead and after the rotating rollers, for example, as is illustrated in a schematic manner in FIGS. 5*a*, 5*b*, and 5*c*. FIG. 5*a* shows two conveying-roller pairs 51, 53 and 52, 54 which are upstream of the rotating device, and two conveying-roller pairs 61, 62, and 63, 64 which are downstream of the rotating device 9. The spacing of the additional conveying rollers is to be chosen such that also the smallest format is always at least by two roller pairs which lie beside one another. The upper conveying rollers are preferably mounted in a sprung manner, such that various thicknesses of the documents and document groups can be processed. For the aforementioned reasons, the conveying-roller pairs are preferably driven on the upper and lower side in an analogous manner to the rotating rollers. If and when required, a plurality of such conveying-roller pairs may be employed one after the other.

However, these additional conveying rollers have to be raised (and ideally also decoupled) for the rotating operation, so that documents to be rotated are only clamped and driven by the two rotating-roller pairs. It is also conceivable for the lower conveying rollers to still be slightly lowered in order to reliably avoid contact with the rotating documents. Raising may be performed in a suitable manner by means of magnets, cylinders, levers, motors, etc. FIG. 5*a* shows the additional conveying rollers during the rotating operation of a document, that is to say in the raised or lowered state, so that the region between the upper and lower roller pairs is vacated. In contrast thereto, FIG. 5*b* shows the state when infeeding or conveying away the document, where the additional conveying-roller pairs are closed and thus enable conveying of the document. However, FIG. 5*b* may also show that situation in which all conveying rollers are engaged for conveying comparatively small documents not to be rotated. FIG. 5*c* shows the roller pairs of FIGS. 5*a* and 5*b* in a plan view. The rotating-roller pairs 11, 12, 13, 14 have separate axles and separate left-hand and right-hand drives B and C, respectively. In the case of the conveying-roller pairs the two upper rollers are situated on a common shaft and the two lower rollers are situated on a common shaft. The axle does not have to be a through-axle, but this is advantageous in order for the left-hand and right-hand rollers to run at the same speed. Ideally, the upper and lower rollers are driven; potentially, only the lower rollers are driven while the upper rollers run freely conjointly. The rollers which are illustrated in a dashed manner are only required in the case of very short minimal lengths of the documents to be processed in comparison with the lengths to be rotated.

In the event of objects of only sufficient length being processed, the additional rollers to be raised for the rotating operation may be omitted.

Figure 6:
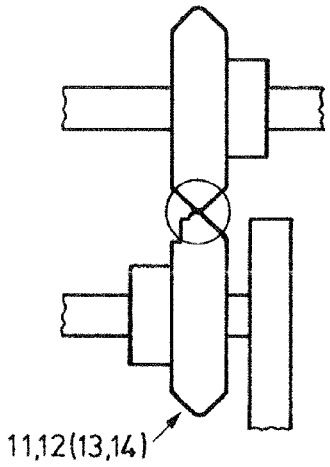
FIG. 6 shows in a schematic manner a rotating-roller pair of the device according to the invention.

The shape of the rotating rollers is of significance. In order to prevent squeezing or rupturing of the paper, the compressing face between paper and rotating rollers has to be very small. Ideally, this is a punctiform contact, as illustrated in FIG. 6, which in practice is barely implementable, however. The material of the rotating roller has to have high friction in relation to the paper, on the one hand, and has to permit easy relative rotating movements, on the other hand.

Figure 7:
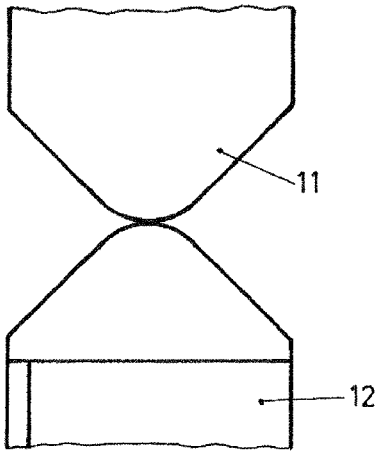
FIG. 7 shows the rotating-roller geometry of the rotating-roller pair of FIG. 6.

FIG. 7, in the manner of a detail, shows the contact region of the rotating rollers, such as the rotating rollers 11, 12, for example.

The illustrations in FIGS. 1 to 7 are of course only examples for better explaining the present invention. The materials used for the rollers, in particular, are not primarily a component part of the present invention, and rollers of rubber, polyurethane, other suitable polymer materials, coatings by means of corundum surfaces and, surprisingly, possibly even smooth surfaces if and when sufficient pressure is exerted, are possible.

The present invention may be employed at the most varied points within a document-processing machine. As has been mentioned at the outset, the invention is described in an exemplary manner for rotating documents, such as sheets, but in general mention may be made of two-dimensional objects or products. In particular, these may be composed also of stacked sheets, or of letter envelopes which are filled or non-filled and have an open or closed flap.

The processing of various document sizes is an advantageous property and therefore the variant of embodiment having, for example, raisable rollers ahead of and after the actual rotating device is a potential embodiment.

The angle of rotation for the documents does not have to be exactly 90°. By way of subsequent aligning in conjunction with an alignment facility, the desired result may also be achieved using angles which are smaller or larger than 90°.

On account of its design, the device is of course also capable of correcting distortions of documents or stacks thereof.

Unintentional buffeting of the corners of the documents during the rotating operation can be prevented by suitable guide plates.

A potential facility for opening the rotating device simplifies the removal of a paper jam.

In contrast to the known methods for rotating documents the present invention offers a higher attainable throughput. On account of the continuous movement of the rotation and of dispensing with start-stop, the conveying of paper is more gentle and the risk of damage and scaling or misalignment of the stack or of individual sheets therein, or of paper jams is reduced. The simple mechanical construction offers the advantage that the movable components have a small mass. On account thereof, the system can be stopped within a very short time in order to react to the influences of downstream systems. On account of avoiding start-stop processes, the machine elements are conserved and less power is required. The device requires little space and, in particular, is capable of rotating also stacked products in a controlled manner.

The invention claimed is:

1. A device for rotating two-dimensional sheet-type or film-type products, or a stack thereof, characterized by at least two drive-roller pairs (11, 12; 13, 14) which are disposed beside one another so as to be spaced apart for conveying the products (1), and configured such that both the upper and lower rotating rollers are driven rollers, sensors configured to measure the position and speed of the products, and a controller configured to receive information from the sensors, the drive speed of said drive-roller pairs (11, 12; 13, 14) being modifiable in such a manner that the two roller pairs, oriented toward the same conveying direction, are operable at different speeds, whereby the speed of at least one of the roller pairs can be modified by the controller after engagement of the products by the two roller pairs in such a manner that products are rotated until the desired rotation is completed without interrupting conveying onward in a linear manner and to rotate products without permanently displacing a conveying axis of the products.

2. The device as claimed in claim 1, characterized in that on at least one roller pair the speed is decreasable in relation to the conveying speed.

3. The device as claimed in claim 1, characterized in that the speed of the one roller pair is decreasable and the speed of the other roller pair is increasable.

4. The device as claimed in claim 1, characterized in that the roller pairs have separate drives (33, 35).

5. The device as claimed in claim 1, characterized in that the product is infed to the roller pairs symmetrically to the roller pairs.

6. The device as claimed in claim 1, characterized in that the position of the product is detectable by means of sensors, said sensors being connected to the drive or the drives of the roller pairs, respectively.

7. The device as claimed in claim 1, characterized in that ahead of and/or after the roller pairs further conveying-roller pairs (51, 52; 53, 54/61, 62; 63, 64) are provided, wherein the rollers are optionally configured so as to be separable from one another in order to permit free rotation during rotation of the product.

8. The device as claimed in claim 1, characterized in that the device selectively enables a rotating operation or a linear conveyance of the products without rotation.

9. A method for rotating at least one sheet-type or film-type product, or a stack thereof, comprising the steps of:

feeding the product to two conveying-roller pairs which are disposed beside one another so as to be spaced apart, monitoring a position and speed of the product with sensors, making corresponding calculations depending on a length of the product by a controller, modifying the speed of at least one of the roller pairs after engagement of the product by the two roller pairs by the controller in such a manner that the product is rotated until the desired rotation is completed, without interrupting conveying onward in a linear manner and without permanently displacing a conveying axis of the product, or a stack thereof, upon which for further conveying of the product the speed of the two roller pairs is set so as to be identical again.

10. The method as claimed in claim 9, characterized in that during the rotating operation the speed of the one roller pair is increased and the speed of the other roller pair is decreased.

11. The method as claimed in claim 9, characterized in that for controlling the speed of the two roller pairs the position, speed, and length of the product is detected by means of sensors.

12. The method as claimed in claim 9, characterized in that ahead of the rotating device the product is infed in a symmetrical manner to the conveying axis and after the rotating device is delivered in a symmetrical manner to the conveying axis.

13. The method as claimed in claim 9, characterized in that, in order to enable the product to slide through the further conveying rollers during the rotating operation, further conveying-roller pairs upstream and/or downstream of the two roller pairs are operable in such a manner that the rollers of the further conveying-roller pairs are separated from one another during the rotating operation of the product.

14. The method as claimed in claim 9, characterized in that the product may selectively be conveyed in a rotated or non-rotated manner.

15. The method as claimed in claim 9, characterized in that the product is a rectangular document which is infed so as to be symmetric to the roller pairs, and the position of the center of the document is modified in such a manner that a rotating operation modifies the center movement in relation to the symmetry axis of the direction of movement of the document until the center again comes to lie on the symmetry axis, upon which the rotation movement is completed and the document is conveyed onward.

* * * * *